US007362342B2

(12) United States Patent
Baek et al.

(10) Patent No.: US 7,362,342 B2
(45) Date of Patent: Apr. 22, 2008

(54) DRIVING APPARATUS AND METHOD FOR LIQUID CRYSTAL DISPLAY

(75) Inventors: Jong Sang Baek, Kumi-shi (KR); Sun Young Kwon, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 652 days.

(21) Appl. No.: 10/873,498

(22) Filed: Jun. 23, 2004

(65) Prior Publication Data

US 2004/0263449 A1 Dec. 30, 2004

(30) Foreign Application Priority Data

Jun. 24, 2003 (KR) ..... 2003-41113

(51) Int. Cl.
*G09G 5/02* (2006.01)

(52) U.S. Cl. ..... 345/694; 348/455

(58) Field of Classification Search ..... 345/694–698, 345/98–100; 348/445, 555, 556, E5.111
See application file for complete search history.

(56) References Cited

U.S. PATENT DOCUMENTS 4,275,421 A * 6/1981 Louie et al. ..... 345/98
5,629,744 A * 5/1997 Kawamura ..... 348/556
6,020,872 A * 2/2000 Mizukata et al. ..... 345/99
6,384,867 B1 5/2002 Seino et al.

FOREIGN PATENT DOCUMENTS

| | | |
|---|---|---|
| CN | 1410956 | 4/2003 |
| JP | 61158247 | 7/1986 |
| JP | 62-219200 | 9/1987 |
| JP | 62-247265 | 10/1987 |
| JP | 6054044 | 2/1994 |
| JP | 2000-338925 | 8/2000 |
| JP | 2000267618 | 9/2000 |

* cited by examiner

*Primary Examiner*—Richard Hjerpe
*Assistant Examiner*—Kevin M Nguyen
(74) *Attorney, Agent, or Firm*—McKenna Long & Aldridge LLP

(57) ABSTRACT

A driving apparatus and apparatus for a liquid crystal display wherein an image format of an NTSC image signal can be selectively converted in response to an instruction of a user. In the apparatus, a liquid crystal display panel has liquid crystal cells arranged at intersections between gate lines and data lines to display an image signal in an image format different from an input image signal. A switch generates a pulse signal by an operation of a user. A counter counts said pulse signal. A timing controller changes an image format of said image signal displayed on the liquid crystal display panel in response to an input signal from the counter.

25 Claims, 8 Drawing Sheets

DRIVING APPARATUS AND METHOD FOR LIQUID CRYSTAL DISPLAY

This application claims the benefit of the Korean Patent Application No. P2003-41113 filed in Korea on Jun. 24, 2003, which is hereby incorporated by reference for all purposes as if fully set forth herein.

BACKGROUND OF THE INVENTION

1. Field of the Invention

This invention relates to a liquid crystal display, and more particularly to a driving apparatus and apparatus for a liquid crystal display wherein an NTSC (National Television System Committee) signal can be selectively converted in response to an instruction of a user.

2. Discussion of the Related Art

Generally, an active matrix liquid crystal display (LCD) uses thin film transistors (TFT's) as switching devices to display a moving picture. Because such a LCD can be made smaller in size than related art cathode-ray tubes, LCDs have been widely used as monitors for personal computers or notebook computers as well as office automation equipment such as copy machines and portable equipment such as cellular phones and pagers.

The active matrix LCD displays a picture corresponding to video signals, such as television signals, on a picture element matrix or pixel matrix having liquid crystal cells arranged at crossings of gate lines and data lines. The thin film transistor is provided at each crossing between the gate lines and the data lines to switch a data signal to be transmitted into the liquid crystal cell in response to a scanning signal (or gate pulse) from the gate line.

Such an LCD is classified as one for displaying NTSC signals and one for PAL signals in accordance with the television signal system in the area in which the LCD is used.

Generally, if an NTSC signal (i.e., 525 vertical lines) is received, then a horizontal resolution of the LCD is expressed in accordance with sampled data while a vertical resolution thereof is expressed by a 234 line de-interlaced scheme. On the other hand, if a PAL signal (i.e., 625 vertical lines) is received, then a horizontal resolution of the LCD is expressed in accordance with sampled data while a vertical resolution thereof is expressed by a processing system similar to the NTSC signal scheme in which one line is removed for each six vertical lines to be resulted in 521 lines.

Referring to FIG. 1, a related art LCD driving apparatus includes a liquid crystal display panel 30 having liquid crystal cells arranged in a matrix type, a gate driver 34 for driving gate lines GL of the liquid crystal display panel 30, a data driver 32 for driving data lines DL of the liquid crystal display panel 30, an image signal processor 10 for converting an NTSC image signal input into a voltage suitable for driving the liquid crystal display panel 30 and for outputting a complex synchronizing signal' a format signal generator 22 that generates a format signal converted for display on the liquid crystal display panel 30, and a timing controller 20 for receiving the complex synchronizing signal from the image signal processor 10 to separately output a horizontal synchronizing signal Hsync and a vertical synchronizing signal Vsync and for controlling the gate driver 34 and the data driver 32 in response to format signals M1, M2 and M3 from the format signal generator 22.

The image signal processor 10 converts an NTSC image signal into a signal suitable for driving the liquid crystal display panel 30, and applies the complex synchronizing signal to the timing controller 20.

The liquid crystal display panel 30 includes liquid crystal cells arranged in a matrix and thin film transistors TFT at the crossing of the gate lines GL and the data lines DL connected to the liquid crystal cells.

The thin film transistor TFT is turned on when a scanning signal, i.e., a gate high voltage VGH from the gate line GL, is applied, and applying a pixel signal from the data line DL to the liquid crystal cell. On the other hand, the thin film transistor TFT is turned off when a gate low voltage VGL is applied from the gate line GL, maintaining a pixel signal charged in the liquid crystal cell.

The liquid crystal cell can be equivalently expressed as a liquid crystal capacitor LC, and includes a pixel electrode connected to a common electrode and the thin film transistor TFT that are opposite each other having a liquid crystal therebetween. Further, the liquid crystal cell includes a storage capacitor Cst for maintaining the charged pixel signal until the next pixel is charged. This storage capacitor Cst is provided between a pre-stage gate line and the pixel electrode. Such an liquid crystal cell varies the alignment state of the liquid crystal having a dielectric anisotropy in response to the pixel signal charged via the thin film transistor TFT to control light transmittance, thereby implementing a gray scale level.

The gate driver 34 sequentially applies the gate high voltage VGH to the gate lines GL in response to gate control signals GSP, GSC and GOE from the timing controller 20. Thus, the gate driver 34 drives the thin film transistors TFT connected to the gate lines GL for each gate line.

More specifically, the gate driver 34 shifts a gate start pulse GSP in response to a gate shift pulse GSC, thereby generating a shift pulse. Further, the gate driver 34 applies the gate high voltage VGH to the corresponding gate line GL every horizontal period H1, H2, . . . in response to the shift pulse. In this case, the gate driver 34 applies the gate high voltage VGH only in an enable period in response to a gate output enable signal GOE. On the other hand, the gate driver 34 applies the gate low voltage VGL in the remaining period when the gate high voltage VGH is not applied to the gate lines GL.

The data driver 32 applies pixel data signals to the data lines DL for each line in every horizontal period 1H, 2H, . . . in response to data control signals SSP, SSC and SOE from the timing controller 20. Particularly, the data driver 32 applies RGB data from the image signal processor 10 to the liquid crystal display panel 30.

More specifically, the data driver 32 shifts a source start pulse SSP in response to a source shift clock SSC to generate a sampling signal. Then, the data driver 32 sequentially inputs analog RGB data for each certain unit in response to the sampling signal to latch them. Further, the data driver 32 applies the latched analog data for one line to the data lines DL.

As shown in FIG. 2, the format signal generator 22 includes a first format signal generator 22*a* having first and second switches SW1 and SW2 connected in series between a voltage source Vcc and a ground voltage source GND, a second format signal generator 22*b* having third and fourth switches SW3 and SW4 connected in series between the voltage source Vcc and the ground voltage source GND, and a third format signal generator 22*c* having fifth and sixth switches SW5 and SW6 connected in series between the voltage source Vcc and the ground voltage source GND.

The format signal generator 22 applies a high-level voltage Vcc from the voltage source Vcc or a ground voltage GND from the ground voltage source GND under switching of each of the first to sixth switches SW1 to SW6 in response to a switching control signal. Herein, the switching control signal is set in advance by a system engineer.

More specifically, the first format signal generator 22*a* applies a first format signal M1 having a high level to a first format signal input terminal at the timing controller 20 when only the first switch SW1, of the first and second switches SW1 and SW2, is turned on while applying a first format signal M1 having a ground level to the first format signal input terminal at the timing controller 20 when only the second switch SW2 is turned on. Likewise, the second format signal generator 22*b* applies a second format signal M2 having a high level to a second format signal input terminal at the timing controller 20 when only the third switch SW3, of the third and fourth switches SW3 and SW4, is turned on while applying a second format signal M2 having a ground level to the second format signal input terminal at the timing controller 20 when only the fourth switch SW4 is turned on. Further, the third format signal generator 22*c* applies a third format signal M3 having a high level to a third format signal input terminal at the timing controller 20 when only the fifth switch SW5, of the fifth and sixth switches SW5 and SW6, is turned on while applying a third format signal M3 having a ground level to the third format signal input terminal at the timing controller 20 when only the sixth switch SW6 is turned on.

The timing controller 20 separates a horizontal synchronizing signal H and a vertical synchronizing signal V from the complex synchronizing signal from the image signal processor 10 to apply them to the data driver 32. Further, the timing controller 20 sets a format of an image signal displayed on the liquid crystal display panel 30 in response to the format signals M1, M2 and M3 from the format signal generator 22, and generates control signals for controlling a driving timing of each of the gate driver 34 and the data driver 32 in accordance with the set format. In other words, the timing controller 20 generates gate control signals GSP, GSC and GOE in response to the format signals M1, M2 and M3 from the format signal generator 22 to control the gate driver 34, and generates data control signals SSP, SSC and SOE to control the data driver 32.

More specifically, the timing controller 20 combines the first through third format signals M1, M2 and M3 from the format signal generator 22 to thereby set a format of the image signal displayed on the liquid crystal display panel 30, and generates and supplies control signals for controlling a driving timing of each of the gate driver 34 and the data driver 32 in accordance with the set format of the image signal. The timing controller 20 combines the first through third format signals M1, M2 and M3 from the format signal generator 22 and selects any one of a plurality of image formats indicated by Table 1 in accordance with a logical value obtained by the above-mentioned combination.

TABLE 1

| M1 | M2 | M3 | Image Format |
|---|---|---|---|
| 0 | 0 | 0 | 1 |
| 0 | 0 | 1 | 2 |
| 0 | 1 | 0 | 3 |
| 0 | 1 | 1 | 4 |
| 1 | 0 | 0 | 5 |
| 1 | 0 | 1 | 6 |
| 1 | 1 | 0 | 7 |
| 1 | 1 | 1 | 8 |

In Table 1, the first through eighth image formats have corresponding values in which the number of data lines and the number of gate lines required to display an image signal on the liquid crystal display panel are different.

In such an LCD driving apparatus and method, any one of a plurality of image formats is selected from the timing controller 20 in response to a switching of each switch SW1 to SW6 of the format signal generator 22 that are set in advance by a system engineer. Thus, the timing controller 20 controls each of the gate driver 34 and the data driver 32 in accordance with the selected image format. Accordingly, an image format selected by the timing controller 20 is displayed on the liquid crystal display panel 30.

The related art LCD driving apparatus and method has a problem in that, because a switching control signal for each switch SW1 to SW6 of the format signal generator 22, used to select an image format for display on the liquid crystal display panel 30, is set in advance by a system engineer, the image format can not be changed in accordance with a user's preference.

SUMMARY OF THE INVENTION

[Accordingly, the present invention is directed to the driving apparatus and method for liquid crystal display that substantially obviates one or more of the problems due to limitations and disadvantages of the related art.] Accordingly, it is an advantage of the present invention to provide a driving apparatus and apparatus for a liquid crystal display wherein an NTSC image signal can be selectively converted to another signal format in response to instruction by a user.

In order to achieve these and other advantages of the invention, a driving apparatus for a liquid crystal display according to an aspect of the present invention includes a liquid crystal display panel, having liquid crystal cells arranged at crossings of gate lines and data lines, for displaying an image signal in an image format different from an input image signal; a switch for generating a pulse signal by an operation of a user; a counter for counting said pulse signal; and a timing controller for changing an image format of said image signal displayed on the liquid crystal display panel in response to an input signal from the counter.

The driving apparatus further includes a flip-flop arranged between the switch and the counter for eliminating a noise of said pulse signal to apply it to the counter.

The driving apparatus further includes an image signal processor for receiving said image signal and applying it to the timing controller; a data driver for driving data lines of the liquid crystal display panel; and a gate driver for driving gate lines of the liquid crystal display panel.

The image formats include a first image format based on a ratio of horizontal width to vertical width such that an image in said format inputted to the timing controller is displayed on the liquid crystal display panel as-is; a second image format having an enlarged ratio of horizontal width to vertical width such that an image in said format inputted to the timing controller is displayed on the entire field of the liquid crystal display panel; and a third image format that proportionately enlarges the ratio of horizontal width to vertical width such that said image signal inputted to the timing controller is displayed on the liquid crystal display panel.

In addition, said first image format includes said input image signal; and a black signal displayed at the periphery of said image signal.

Said third image format includes an image signal displayed by being enlarged on a constant ratio of horizontal width to vertical width from said input image signal; and a black signal displayed on the upper and lower edges of said image signal.

Alternatively, said third image format includes an image signal displayed while being enlarged at a constant ratio of horizontal width to vertical width from an image format of said input image signal; and a black signal displayed on the left and right edges of said image signal.

Said timing controller selects any one of the first through third image formats in response to an input signal from the counter, and controls the gate driver and the data driver in accordance with the selected image format.

At least one of the counter and the flip-flop is built into the timing controller.

A driving apparatus for a liquid crystal display according to another aspect of the present invention includes a liquid crystal display panel for displaying an input image signal; a data converter for changing a ratio of horizontal width to vertical width of said image signal displayed on the liquid crystal display panel by an operation of a user to thereby change an image format of said image signal; and a data driver for applying said image signal from the data converter to the liquid crystal display panel in accordance with said changed image format.

In the driving apparatus, said data converter includes a switch for generating a pulse signal by an operation of a user; a counter for counting said pulse signal; and a timing controller for changing an image format of said image signal displayed on the liquid crystal display panel in response to an input signal from the counter.

Herein, said data converter includes a flip-flop arranged between the switch and the counter for eliminating a noise of said pulse signal to apply it to the counter.

The driving apparatus further includes an image signal processor for receiving said image signal and applying it to the timing controller; and a gate driver for applying a scanning signal to the liquid crystal display panel.

The image formats include a first image format having a ratio of horizontal width to vertical width such that an image signal input to the timing controller is displayed on the liquid crystal display panel as-is; a second image format enlarged at a ratio of horizontal width to vertical width such that an image format of said image signal inputted to the timing controller is displayed on the entire field of the liquid crystal display panel; and a third image format enlarged constantly at a ratio of horizontal width to vertical width such that an image format of said image signal inputted to the timing controller is displayed on the liquid crystal display panel.

Herein, said first image format includes said input image signal; and a black signal displayed at the periphery of said image signal.

Said third image format includes an image signal displayed with being enlarged constantly at a ratio of horizontal width to vertical width from an image format of said input image signal; and a black signal displayed on the upper and lower edges of said image signal.

Alternatively, said third image format includes an image signal displayed with being enlarged constantly at a ratio of horizontal width to vertical width from an image format of said input image signal; and a black signal displayed on the left and right edges of said image signal.

Said timing controller selects any one of the first to third image formats in response to an input signal from the counter, and controls the gate driver and the data driver in accordance with the selected image format.

A method of driving a liquid crystal display according to still another aspect of the present invention includes the steps of providing a liquid crystal display panel, having liquid crystal cells arranged at intersections between gate lines and data lines, for displaying an image signal in an image format different from an input image signal; generating a pulse signal by an operation of a user; counting said pulse signal using a counter; and changing an image format of said image signal displayed on the liquid crystal display panel in response to an input signal from the counter.

The method further includes the step of eliminating noise from said pulse signal from the counter.

Herein, said image format includes a first image format maintained at a ratio of horizontal width to vertical width as it is such that an image format of said image signal inputted to the timing controller is displayed on the liquid crystal display panel as it is; a second image format enlarged at a ratio of horizontal width to vertical width such that an image format of said image signal inputted to the timing controller is displayed on the entire field of the liquid crystal display panel; and a third image format enlarged constantly at a ratio of horizontal width to vertical width such that an image format of said image signal inputted to the timing controller is displayed on the liquid crystal display panel.

Herein, said first image format includes said input image signal; and a black signal displayed at the periphery of said image signal.

Said third image format includes an image signal displayed with being enlarged constantly at a ratio of horizontal width to vertical width from an image format of said input image signal; and a black signal displayed on the upper and lower edges of said image signal.

Alternatively, said third image format includes an image signal displayed with being enlarged constantly at a ratio of horizontal width to vertical width from an image format of said input image signal; and a black signal displayed on the left and right edges of said image signal.

Said step of changing an image format of said image signal displayed on the liquid crystal display panel includes selecting any one of the first to third image formats in response to an input signal from the counter; and controlling a gate driver for driving the gate lines and a data driver for driving the data lines in accordance with the selected image format.

It is to be understood that both the foregoing general description and the following detailed description are exemplary and explanatory and are intended to provide further explanation of the invention as claimed.

BRIEF DESCRIPTION OF THE DRAWINGS

[The accompanying drawings, which are included to provide a further understanding of the invention and are incorporated in and constitute a part of this specification, illustrate embodiments of the invention and together with the description serve to explain the principles of the invention.] These and other advantages of the invention will be apparent from the following detailed description of the embodiments of the present invention with reference to the accompanying drawings, in which.

DETAILED DESCRIPTION OF THE ILLUSTRATED EMBODIMENTS

Figure 1:
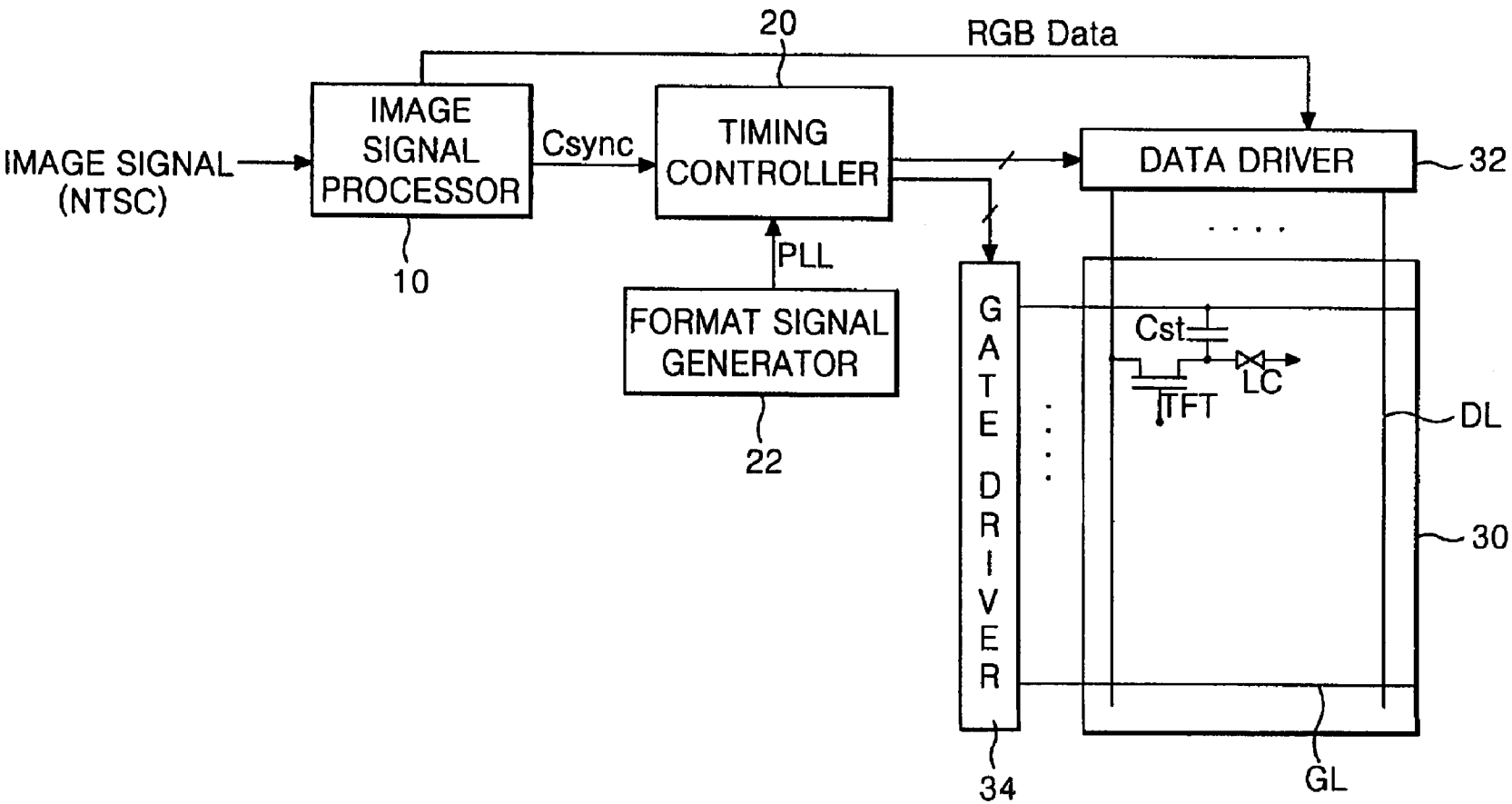
FIG. 1 RELATED ART
FIG. 1 is a schematic block diagram illustrating a configuration of a conventional driving apparatus for a liquid crystal display.
Figure 2:
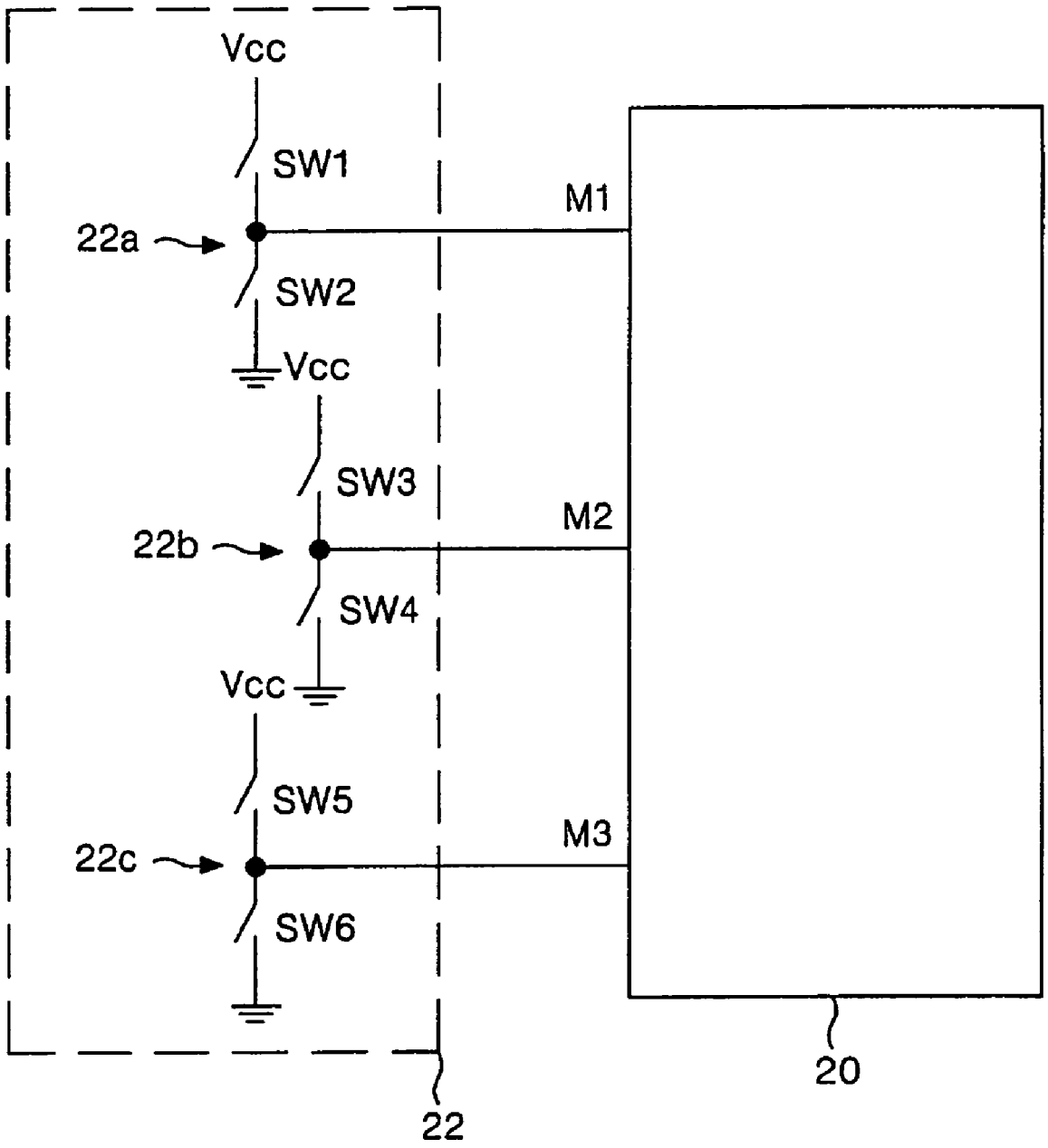
FIG.2 RELATED ART
FIG. 2 is a circuit diagram of the format signal generator illustrated in FIG. 1.
Figure 3:
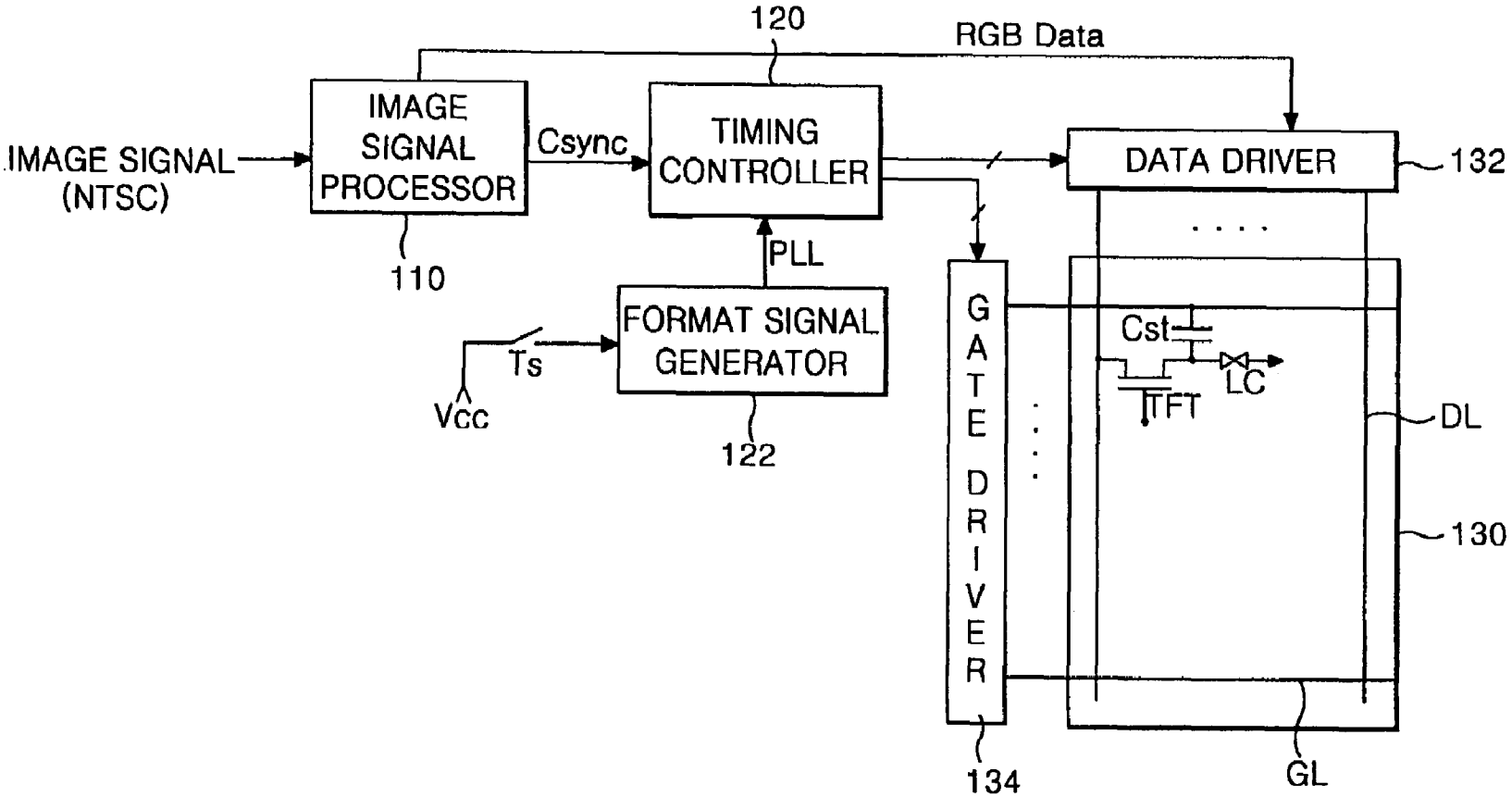
FIG. 3 is a schematic block diagram illustrating a configuration of a driving apparatus for a liquid crystal display according to an embodiment of the present invention.

Referring to FIG. 3, an LCD driving apparatus according to an embodiment of the present invention includes a liquid crystal display panel 130 having liquid crystal cells arranged in a matrix, a gate driver 134 for driving gate lines GL of the liquid crystal display panel 130, a data driver 132 for driving data lines DL of the liquid crystal display panel 130, an image signal processor 110 for converting an NTSC image signal into a voltage suitable for driving the liquid crystal display panel 130 and for outputting a complex synchronizing signal from the image signal NTSC, and a toggle switch Ts for generating a pulse signal for operation by a user, a format signal generator 122 for converting a format of the image signal NTSC displayed on the liquid crystal display panel 130 in response to the pulse signal from the toggle switch Ts, and a timing controller 120 for receiving the complex synchronizing signal from the image signal processor 110 to separately output a horizontal synchronizing signal and a vertical synchronizing signal and for controlling the gate driver 134 and the data driver 132 in response to the format signal MS from the format signal generator 122.

The image signal processor 110 converts an NTSC image signal into a voltage suitable for driving the liquid crystal display panel 130 in accordance with a property of the liquid crystal display panel 130 by applying it to the data driver 132, and applies the complex synchronizing signal to the timing controller 120.

The liquid crystal display panel 130 includes liquid crystal cells arranged in a matrix and thin film transistors TFT provided at crossings of the gate lines GL and the data lines DL to be connected to the liquid crystal cells.

The thin film transistor TFT is turned on when a scanning signal such as a gate high voltage VGH from the gate line GL is applied thereby applying a pixel signal from the data line DL to the liquid crystal cell. On the other hand, the thin film transistor TFT is turned off when a gate low voltage VGL is applied from the gate line GL, to thereby maintain a pixel signal charged in the liquid crystal cell.

The liquid crystal cell can be equivalently expressed as a liquid crystal capacitor LC, and includes a pixel electrode connected to a common electrode and the thin film transistor TFT that are opposed to each other with a liquid crystal therebetween. Further, the liquid crystal cell includes a storage capacitor Cst for stably maintaining the pixel charge until the next pixel signal is received. This storage capacitor Cst is provided between a pre-stage gate line and the pixel electrode. Such a liquid crystal cell varies an alignment state of the liquid crystal through its dielectric characteristics in response to the pixel signal charged via the thin film transistor TFT to control light transmittance to thereby implement a gray scale level.

The gate driver 134 sequentially applies the gate high voltage VGH to the gate lines GL in response to gate control signals GSP, GSC and GOE from the timing controller 120. Thus, the gate driver 134 allows the thin film transistors TFT connected to the gate lines GL to be driven for each gate line.

More specifically, the gate driver 134 shifts a gate start pulse GSP in response to a gate shift pulse GSC (thereby generating a shift pulse). Further, the gate driver 134 applies the gate high voltage VGH to the corresponding gate line GL every horizontal period H1, H2, . . . in response to the shift pulse. In this particular example, the gate driver 134 applies the gate high voltage VGH only in an enable period in response to a gate output enable signal GOE. On the other hand, the gate driver 134 applies the gate low voltage VGL in the remaining part of the horizontal period when the gate high voltage VGH is not applied to the gate lines GL.

The data driver 132 applies pixel data signals for each line to the data lines DL every horizontal period 1H, 2H, . . . in response to data control signals SSP, SSC and SOE from the timing controller 120. Particularly, the data driver 132 applies RGB data from the image signal processor 110 to the liquid crystal display panel 130.

The toggle switch Ts is switched by a user to generate a pulse signal. The pulse signal generated by the toggle switch Ts is applied to the format signal generator 122.

Figure 4:
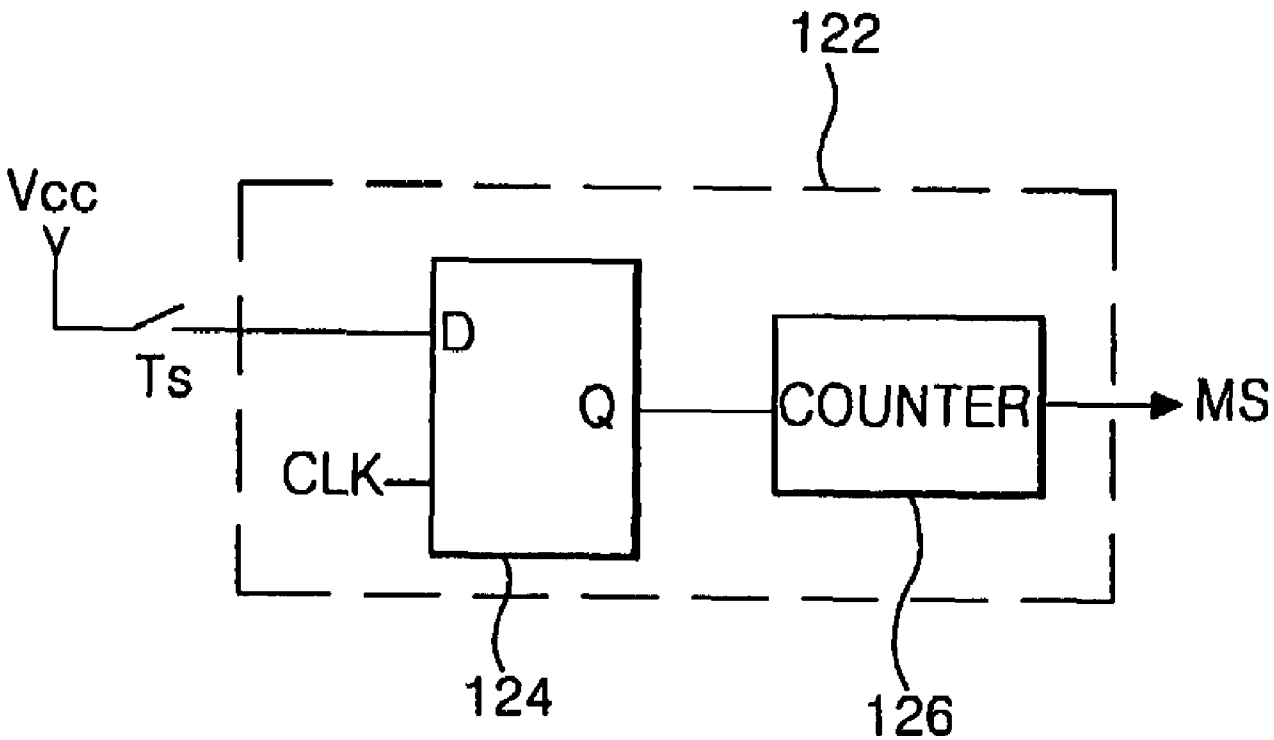
FIG. 4 is a circuit diagram of the format signal generator illustrated in FIG. 3.

As shown in FIG. 4, the format signal generator 122 includes a D flip-flop 124 for eliminating a noise component of a pulse signal inputted from the toggle switch Ts, and a counter 126 for counting an output signal from the D flip-flop 124.

An input terminal D of the D flip-flop 124 is supplied with a pulse signal from the toggle switch Ts while a clock terminal thereof is supplied with a reference clock CLK. Such a flip-flop 124 eliminates a noise component of the pulse signal from the toggle switch Ts using the reference clock CLK to apply it to the counter 126.

The counter 126 counts an output signal from the D flip-flop 124, and applies the counted format signal MS to the timing controller 120.

The format signal generator 122 changes whenever the toggle switch Ts is toggled by a user, and it increments the counter 126 by one. The D flip-flop 124 and the counter 126 of the format signal generator 122 may be built into the timing controller 120.

The timing controller 120 separates a horizontal synchronizing signal and a vertical synchronizing signal from the complex synchronizing signal that came from the image signal processor 110. The timing controller 120 then applies them to the data driver 132. Further, the timing controller 120 sets a format of an image signal displayed on the liquid crystal display panel 130 in response to the format signal MS from the format signal generator 122, and generates control signals for controlling a driving timing of each of the gate driver 134 and the data driver 132 in accordance with the set format. In other words, the timing controller 120 generates gate control signals GSP, GSC and GOE to control the gate driver 134, in response to the format signal MS from the format signal generator 122 and generates data control signals SSP, SSC and SOE to control the data driver 132. In this case, the toggle switch Ts, the format signal generator 122 and the timing controller 120 function as a data converter for changing a format of the image signal displayed on the liquid crystal display panel 130 by an operation of a user.

More specifically, the timing controller 120 combines the first to third format signals M1, M2 and M3 from the format signal generator 122 to thereby set a format of the image signal displayed on the liquid crystal display panel 130, and generates and supplies control signals for controlling a driving timing of each of the gate driver 134 and the data driver 132 in accordance with the set format of the image signal. At this time, the timing controller 120 selects an image format according to the format signal MS from the format signal generator 122.

Figure 5:
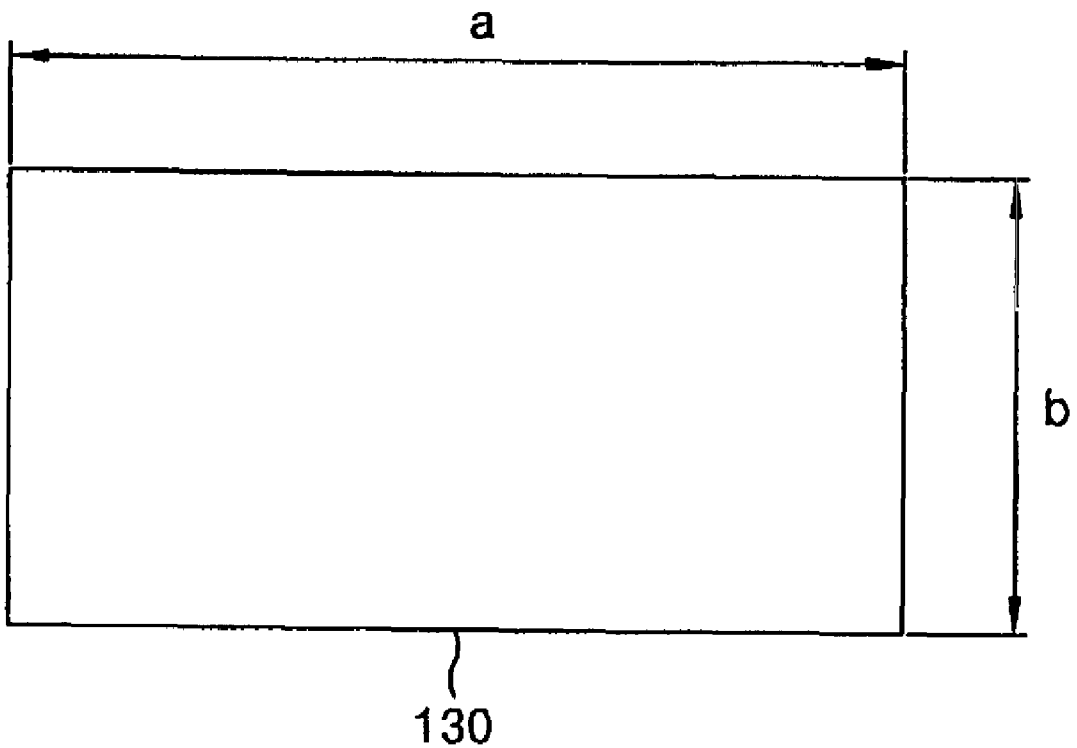
FIG. 5 illustrates an image format for displaying an enlarged input signal on the entire field of the liquid crystal display panel.
Figure 6:
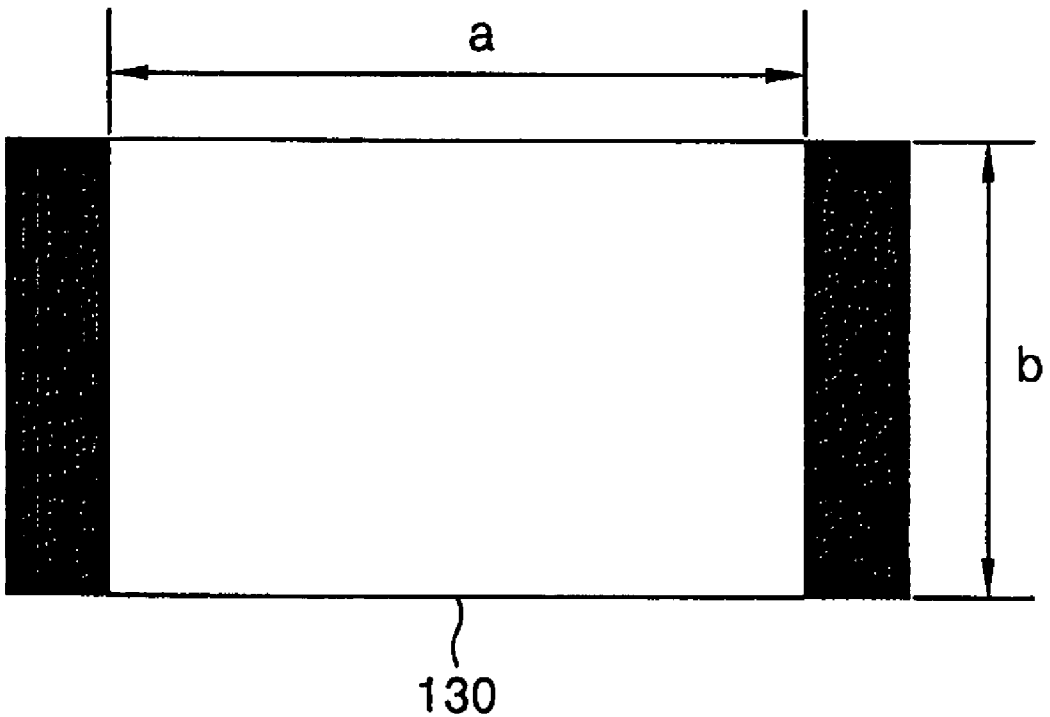
FIG. 6 illustrates an image format for displaying an enlarged input signal, along with a black signal, on the left and right edges of the liquid crystal display panel.
Figure 7:
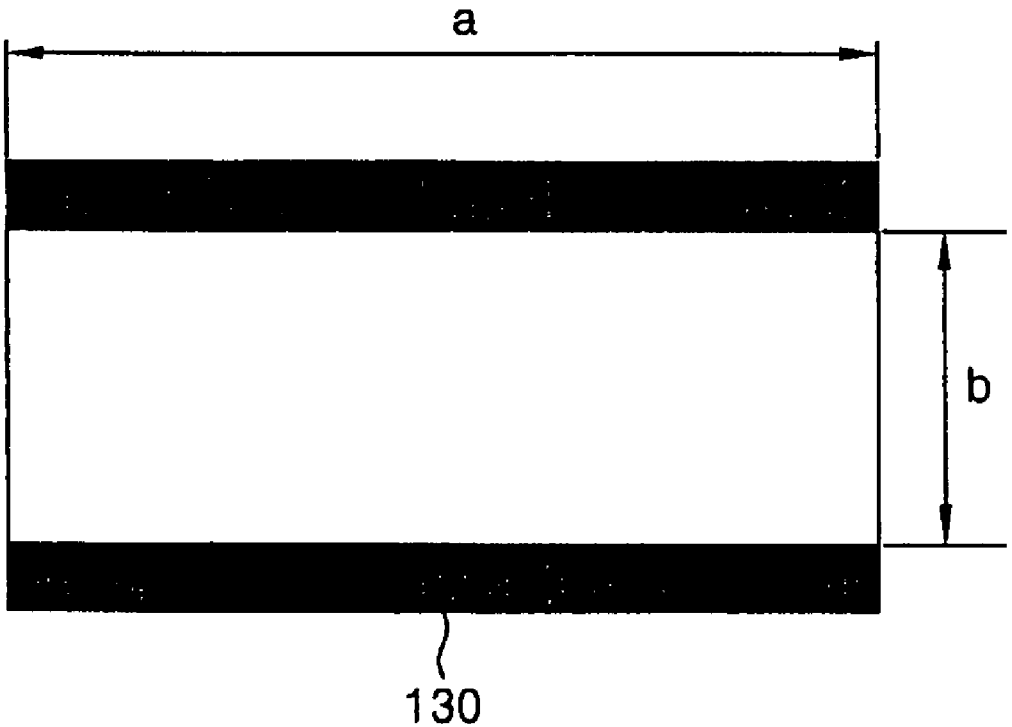
FIG. 7 illustrates an image format for displaying an enlarged input signal, along with a black signal, on the upper and lower edges of the liquid crystal display panel.

An image format selected from the timing controller 120 in response to the format signal MS is set such that the number (a) of data lines and the number (b) of gate lines for displaying an image signal on the liquid crystal display panel 130 is different from each other as shown in FIG. 5 to FIG. 7.

For instance, when a user switches the toggle switch Ts once, an image format selected by the timing controller 120 to be displayed on the liquid crystal display panel 130 allows an image signal to be enlarged at a ratio of 16 to 9 (i.e., 16:9), to thereby display a picture on the entire field of the liquid crystal display panel 130 as shown in FIG. 5. Further, when a user switches the toggle switch Ts twice, an image format selected by the timing controller 120 to be displayed on the liquid crystal display panel 130 allows an image signal to be enlarged at a ratio of 16 to 9 (i.e., 16:9), to thereby display a picture such that there exists a blank area at which only the black signal rather than the image signal is displayed on the left and right sides of the liquid crystal display panel 130 as shown in FIG. 6. Moreover, when a user switches the toggle switch Ts three times, an image format selected by the timing controller 120 to be displayed on the liquid crystal display panel 130 allows an image signal to be enlarged at a ratio of 16 to 9 (i.e., 16:9), to thereby display a picture such that there exists a blank area at which only the black signal rather than the image signal is displayed on the upper and lower sides of the liquid crystal display panel 130 as shown in FIG. 6.

In this manner, regardless of the height and width ratio of the original input signal, the signal may be displayed by a display of the present invention such that the original image is not distorted by stretching or compressing.

Figure 8:
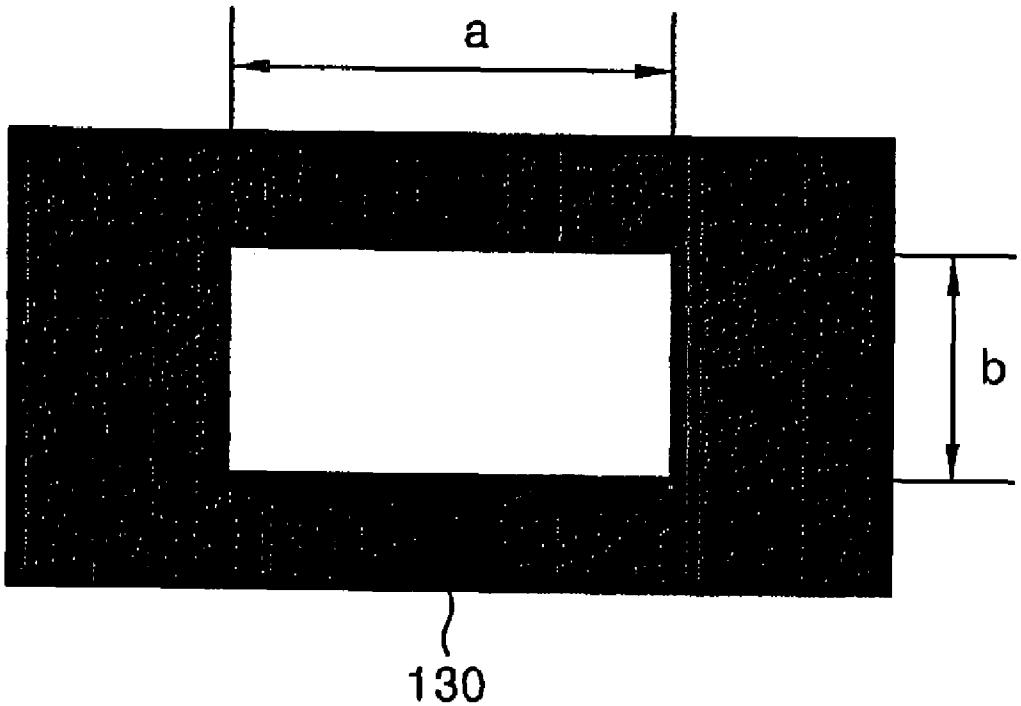
FIG. 8 illustrates an image format for displaying an input image signal on the liquid crystal display panel at its own ratio.

Otherwise, when a user switches the toggle switch Ts four times, an image format selected by the timing controller 120 to be displayed on the liquid crystal display panel 130 allows an image signal to be at an original ratio of 4 to 3. (i.e., 4:3) as it is, to thereby display a picture such that there exists a blank area at which only the black signal rather than the image signal is displayed on the left, right, upper and lower sides of the liquid crystal display panel 130 as shown in FIG. 8.

Alternatively, various image formats may be displayed on the liquid crystal display panel 130 by a user switching the toggle switch Ts.

In other words, the original input signal is enlarged by adding black signal into those portions of the image signal for display on the LCD display that correspond to areas of LCD display that are larger than or out of proportion to the original image signal.

For example, if the original image signal has a ratio of width to height of 4 to 3 (or 12 to 9), then the LCD display, having dimensions in the ratio of 16 to 9 is too large horizontally than is necessary to display the original signal. Thus, the LCD display of the present invention enlarges the original image signal by adding black signal to the original image signal. The black signal is added into the signal so as to display black on the left and right periphery of the LCD display.

Furthermore, the present invention is not limited to black signal, but rather is understood to contemplate other colors or patterns as well.

As described above, according to the present invention, there are provided the toggle switch for generating a pulse signal by an operation of a user, a counter for counting the pulse signal in response to a switching of the toggle switch, and a timing controller for setting an image format displayed on the liquid crystal display panel in response to a counting signal from the counter. Thus, an image format of the image signal displayed on the liquid crystal display panel can be changed by an operation of a user. Accordingly, it becomes possible to change an image format of the image signal displayed on the liquid crystal display panel in accordance with a user's preference.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus for a liquid crystal display, comprising:

a liquid crystal display panel with liquid crystal cells arranged at crossings of gate lines and data lines;

a switch that generates a pulse signal upon an actuation of the switch;

a counter that receives pulse signals from the switch and that outputs a count signal that corresponds to a count of actuations of the switch; and a timing controller that changes an image format of an input image signal into a display image signal having a selected image format to be displayed on the liquid crystal display panel, the selected image format selected in response to the count signal output by the counter.

2. The driving apparatus as claimed in claim 1, further comprising:

a flip-flop arranged between the switch and the counter, the flip-flop eliminating noise in the pulse signals received by the counter from the switch.

3. The driving apparatus as claimed in claim 2, wherein at least one of the counter and the flip-flop is built in the timing controller.

4. The driving apparatus as claimed in claim 1, further comprising:

an image signal processor that receives the input image signal;

a data driver that drives data lines of the liquid crystal display panel; and a gate driver that drives gate lines of the liquid crystal display panel.

5. The driving apparatus as claimed in claim 4, wherein the selected image format is any of:

a first image format that maintains a ratio of horizontal width to vertical width of the image signal inputted to the timing controller is displayed on the liquid crystal display panel unchanged;

a second image format that enlarges a ratio of horizontal width to vertical width such that the image signal inputted to the timing controller is displayed on the entire field of the liquid crystal display panel; and a third image format that enlarges a ratio of horizontal width to vertical width such that an image format of the image signal inputted to the timing controller is displayed on the liquid crystal display panel.

6. The driving apparatus as claimed in claim 5, wherein the first image format includes:

the input image signal; and a black signal displayed at the periphery of the image signal.

7. The driving apparatus as claimed in claim 5, wherein the third image format includes:

an image signal displayed after being enlarged constantly at a ratio of horizontal width to vertical width from the input image signal; and a black signal displayed on the upper and lower edges of the image signal.

8. The driving apparatus as claimed in claim 5, wherein the third image format includes:

an image signal displayed after being enlarged constantly at a ratio of horizontal width to vertical width from an image format of the input image signal; and a black signal displayed on the left and right edges of the image signal.

9. The driving apparatus as claimed in claim 5, wherein the timing controller selects any one of the first to third image formats in response to an input signal from the counter as the selected image format, and controls the gate driver and the data driver in accordance with the selected image format.

10. The method as claimed in claim 5, wherein the third image format includes:

an image signal displayed with being enlarged constantly at a ratio of horizontal width to vertical width from an image format of the input image signal; and a black signal displayed on the upper and lower edges of the image signal.

11. The method as claimed in claim 1, further comprising the step of:

eliminating a noise of the pulse signal to apply it to the counter.

12. A driving apparatus for a liquid crystal display, comprising:

a liquid crystal display panel that displays an input image signal;

a data converter that changes a ratio of horizontal width to vertical width of the image signal displayed on the liquid crystal display panel to thereby change an image format of the image signal; and a data driver that applies the image signal from the data converter to the liquid crystal display panel in accordance with the changed image format, wherein the data converter includes:

a switch for generating a pulse signal by an operation of a user;

a counter that receives pulse signals generated by the switch and that outputs a count signal that corresponds to a count of operations of the switch by the user, wherein each operation of the switch by the user increments the counter; and a timing controller for changing an image format of the image signal to be displayed on the liquid crystal display panel to a selected image format selected in response to the count signal output by the counter.

13. A driving apparatus for a liquid crystal display, comprising:

a liquid crystal display panel that displays an input image signal;

a data converter that changes a ratio of horizontal width to vertical width of the image signal displayed on the liquid crystal display panel to thereby change an image format of the image signal; and a data driver that applies the image signal from the data converter to the liquid crystal display panel in accordance with the changed image format, wherein the data converter includes:

a switch for generating a pulse signal by an operation of a user;

a counter that receives pulse signals generated by the switch and that outputs a count signal that corresponds to a count of operations of the switch by the user; and a timing controller for changing an image format of the image signal to be displayed on the liquid crystal display panel to a selected image format selected in response to the count signal output by the counter.

14. The driving apparatus as claimed in claim 13, wherein the data converter includes:

a flip-flop arranged between the switch and the counter and eliminating a noise of the pulse signal to apply it to the counter.

15. The driving apparatus as claimed in claim 13, further comprising:

an image signal processor that receives the image signal; and a gate driver that applies a scanning signal to the liquid crystal display panel.

16. The driving apparatus as claimed in claim 15, wherein the selected image format includes one of:

a first image format maintained at a ratio of horizontal width to vertical width as it is such that an image format of the image signal inputted to the timing controller is displayed on the liquid crystal display panel as it is;

a second image format enlarged at a ratio of horizontal width to vertical width such that an image format of the image signal inputted to the timing controller is displayed on the entire field of the liquid crystal display panel; and a third image format enlarged constantly at a ratio of horizontal width to vertical width such that an image format of the image signal inputted to the timing controller is displayed on the liquid crystal display panel.

17. The driving apparatus as claimed in claim 16, wherein the first image format includes:

the input image signal; and a black signal displayed at the periphery of the image signal.

18. The driving apparatus as claimed in claim 16, wherein the third image format includes:

an image signal displayed with being enlarged constantly at a ratio of horizontal width to vertical width from an image format of the input image signal; and a black signal displayed on the upper and lower edges of the image signal.

19. The driving apparatus as claimed in claim 16, wherein the third image format includes:

an image signal displayed with being enlarged constantly at a ratio of horizontal width to vertical width from an image format of the input image signal; and a black signal displayed on the left and right edges of the image signal.

20. The driving apparatus as claimed in claim 16, wherein the timing controller selects any one of the first to third image formats in response to an input signal from the counter as the selected image format, and controls the gate driver and the data driver in accordance with the selected image format.

21. A method of driving a liquid crystal display, comprising the steps of:

providing a liquid crystal display panel, having liquid crystal cells arranged at intersections between gate lines and data lines, for displaying an image signal in an image format different from an input image signal;

generating a pulse signal by an operation of a user;

counting pulse signals generated by operation of the user using a counter to generate a count signal that corresponds to a count of operations of the user; and changing an image format of the image signal displayed on the liquid crystal display panel to a selected image format selected in response to the count signal output from the counter.

22. The method as claimed in claim 21, wherein the selected image format includes:

a first image format maintained at a ratio of horizontal width to vertical width as it is such that an image format of the image signal inputted to the timing controller is displayed on the liquid crystal display panel as it is;

a second image format enlarged at a ratio of horizontal width to vertical width such that an image format of the image signal inputted to the timing controller is displayed on the entire field of the liquid crystal display panel; and a third image format enlarged constantly at a ratio of horizontal width to vertical width such that an image format of the image signal inputted to the timing controller is displayed on the liquid crystal display panel.

23. The method as claimed in claim 21, wherein the first image format includes:

the input image signal; and a black signal displayed at the periphery of the image signal.

24. The method as claimed in claim 21, wherein the third image format includes:

an image signal displayed with being enlarged constantly at a ratio of horizontal width to vertical width from an image format of the input image signal; and a black signal displayed on the left and right edges of the image signal.

25. The method as claimed in claim 21, wherein the step of changing an image format of said image signal displayed on the liquid crystal display panel includes:

selecting any one of the first to third image formats in response to an input signal from the counter; and controlling a gate driver for driving the gate lines and a data driver for driving the data lines in accordance with the selected image format.

* * * * *